US006202581B1

(12) United States Patent
Hattori et al.

(10) Patent No.: US 6,202,581 B1
(45) Date of Patent: Mar. 20, 2001

(54) HEADGEAR FRAME APPARATUS WITH AUXILIARY ROLLERS

(75) Inventors: Osamu Hattori; Masahiko Ozeki, both of Ichinomiya (JP)

(73) Assignee: Kabushiki Kaisha Barudan, Ichinomiya (JP)

( * ) Notice: Subject to any disclaimer, the term of this patent is extended or adjusted under 35 U.S.C. 154(b) by 0 days.

(21) Appl. No.: 09/537,507

(22) Filed: Mar. 29, 2000

(30) Foreign Application Priority Data

Mar. 30, 1999 (JP) ..... 11-127519
Apr. 14, 1999 (JP) ..... 11-106171

(51) Int. Cl.[7] ..... D05C 9/04
(52) U.S. Cl. ..... 112/103
(58) Field of Search ..... 112/103, 309, 112/475.11, 470.08; 38/102, 102.91

(56) References Cited

U.S. PATENT DOCUMENTS 5,553,560 * 9/1996 Tajima et al. ..... 112/309 X
5,915,314 * 6/1999 Moore, III ..... 112/103
6,065,413 * 5/2000 Kawaguchi ..... 112/103 X
6,119,609 * 9/2000 Kawaguchi et al. ..... 112/475.11 X

* cited by examiner

*Primary Examiner*—Ismael Izaguirre
(74) *Attorney, Agent, or Firm*—Pillsbury Winthrop LLP

(57) ABSTRACT

A headgear frame apparatus comprises auxiliary rollers for rotating in abutment against a boundary corner portion between a circumferential portion and a crest portion of a headgear. The headgear is clamped by a headgear frame. The auxiliary rollers are rotatably disposed sideways of a cylindrical bed of a sewing machine.

13 Claims, 5 Drawing Sheets

HEADGEAR FRAME APPARATUS WITH AUXILIARY ROLLERS

BACKGROUND OF THE INVENTION

1. Field of the Invention

The present invention relates to a headgear frame apparatus of a sewing machine for embroidering a headgear.

2. Description of the Related Art

As shown in FIG. 5, a conventional headgear frame apparatus 105 is provided with: a headgear frame 100 for clamping a headgear 1; a rotary drive frame 106 for fitting said headgear frame 100 replaceably thereon on the side of a sewing machine; a support frame 109 for supporting said rotary drive frame 106 rotatably; and a guide plate 110 fixed on said support frame 109 and extending to the side of a cylindrical bed 111 of the sewing machine. The guide plate 110 pushes forward boundary corner portion 7 between the circumferential portion 5 and the crest portion 6 of the headgear 1 at its leading end edge thereby to tense the circumferential portion (or a range to be embroidered) of the headgear 1 over the cylindrical bed 111.

Here, the circumferential portion 5 and the crest portion 6 of the headgear 1 are formed by stitching cloths 1*a*, each of which is cut in a generally triangular shape, and reinforcing cloth bands are so stitched to the inner side of the headgear 1 as to cover that stitched portions, so that band-shaped ridges 8 are formed along the stitched portions. When the headgear 1 is turned at a high speed during the embroidering operation by the rotary drive frame 106, the edge portion (especially the leading end side) of the guide plate 110 is caught by that ridges 8 (especially in the vicinities of the boundary corner portion 7) to cause problems that (1) the boundary corner portion 7 is damaged, and that (2) the side of the crest portion 6 of the headgear 1 cannot follow the rotation of the rotary drive frame 106 to twist the circumferential portion 5 of the headgear 1.

These problems make it difficult to push the boundary corner portion 7 sufficiently with the leading end edge of the guide plate 110. As a result, the tension of the range to be embroidered is insufficient to wrinkle the headgear 1 during the embroidering operation and shrink the cloth of the headgear by the embroidering operation so that the headgear 1 is poorly stitched.

SUMMARY OF THE INVENTION

An object of the invention is to provide a headgear frame apparatus capable of holding a headgear with a range to be embroidered being sufficiently tensed.

In the invention, therefore, there are taken the following means, as will be individually described with reference to FIGS. 1 to 4.

According to an aspect of the invention, there is provided a headgear frame apparatus 9 characterized in that auxiliary rollers 42 for rotating in abutment against boundary corner portion 7 between a circumferential portion 5 and a crest portion of a headgear 1 clamped by a headgear frame 10 are rotatably disposed sideways (i.e., on the left and right sides in the shown embodiment) of a cylindrical bed 91 of a sewing machine.

According to another aspect of the invention, there is provided a headgear frame apparatus 9 comprising: a headgear frame 10 for clamping a headgear 1; a rotary drive frame 30 for fitting said headgear frame 10 replaceably thereon on the side of a sewing machine; and a support frame 40 for supporting said rotary drive frame 30 rotatably, characterized:

in that said support frame 40 is provided with (two in the shown embodiment) elastic plates 41 extending to the side (i.e., the left and right sides in the shown embodiment) of a cylindrical bed 91 of the sewing machine and capable of warping in the directions close to and apart from the cylindrical bed 91; and in that the elastic plates 41 are provided rotatably with auxiliary rollers 42 for rotating in abutment against a boundary corner portion 7 between a circumferential portion 5 and a crest portion 6 of the headgear 1 clamped by the headgear frame 10.

The headgear 1 includes a cap, a hat, a beret and any others which can be embroidered and worn on the head.

As in the shown embodiment, it is preferable that the auxiliary rollers 42 are provided with semispherical faces 43 or conical faces for fitting on the boundary corner portion 7.

As in the shown embodiment, it is preferable that the elastic plates 41 are provided with contact pit faces for contacting with the circumferential portion 5 of the headgear 1.

As in the shown embodiment, it is preferable that the contact pit faces 44 are adjusted to be positioned generally on the extension of the arcuate surface of a throat plate 92 of the cylindrical bed 91.

As in the shown embodiment, it is preferable that the elastic plates 41 are mounted at an adjustable position on a stay 45 projected from the support frame 40 by means of screws 46. By these positional adjustments, the auxiliary rollers 42 can be adjusted to abut snugly against the boundary corner portion 7, and the contact pit faces 44 can be adjusted to be positioned generally on the extensions of the arcuate surface of the throat plate 92.

The following effects can be achieved according to the headgear frame apparatus 9:

Since the auxiliary rollers 42 abut against the boundary corner portion 7 of the headgear 1, the headgear 1 is tensed longitudinally to be hardly wrinkled, and the cloth being embroidered is little shrunk. As a result, the headgear 1 is decoratively embroidered; and When the headgear 1 is to be embroidered in the turning direction, moreover, the auxiliary rollers 42 come, while rotating, into abutment against the boundary corner portion 7 so that they will not damage the boundary corner portion 7. Because of little friction (or drag) at this time, moreover, the motion of the headgear 1 is smoothed in the turning direction in the vicinities of the pits (i.e., the contact pit faces 44).

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE PREFERRED EMBODIMENTS

Figure 1:
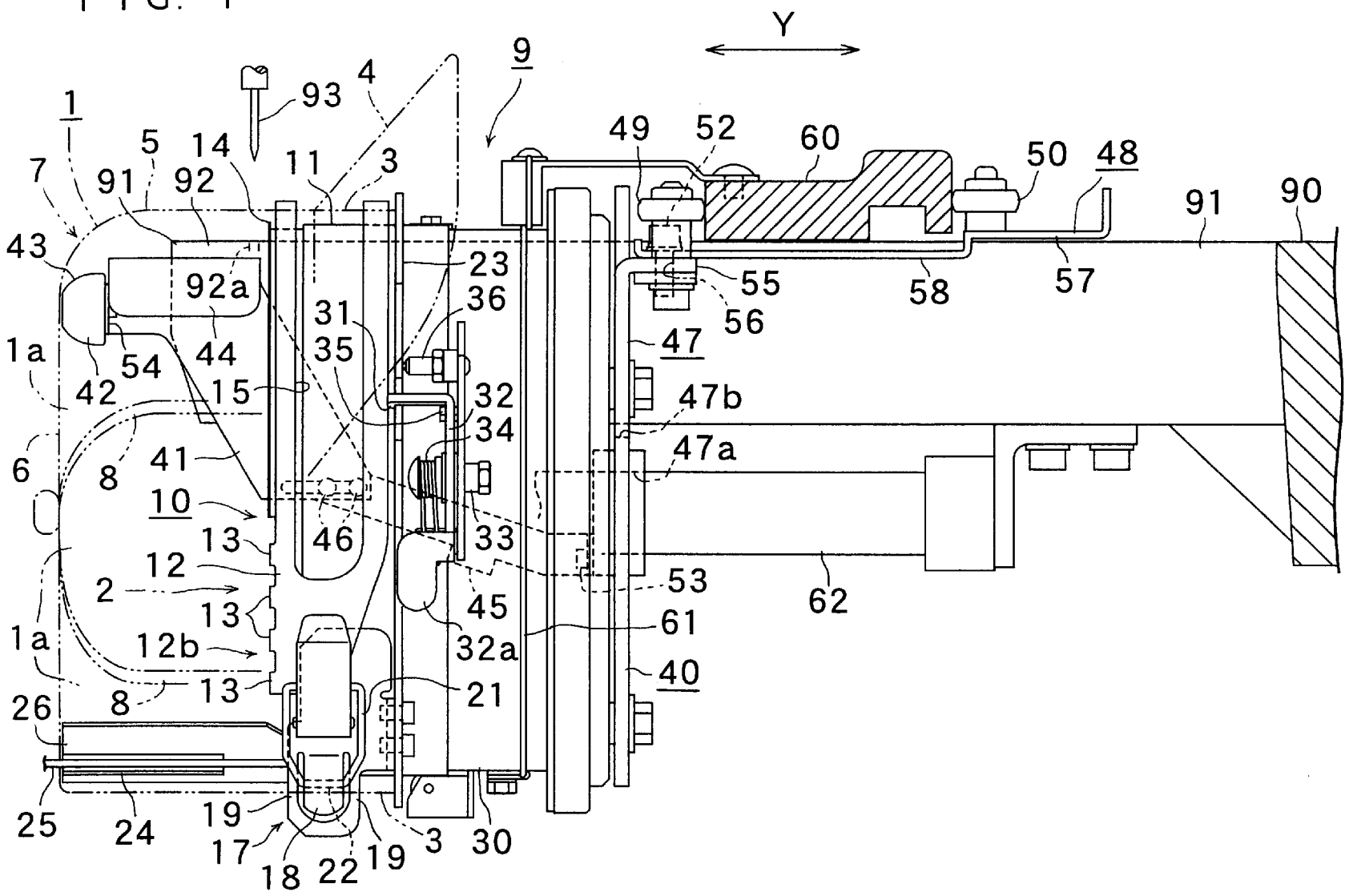
FIG. 1 is a righthand side view showing a headgear frame apparatus for a sewing machine according to an embodiment of the invention.
Figure 2:
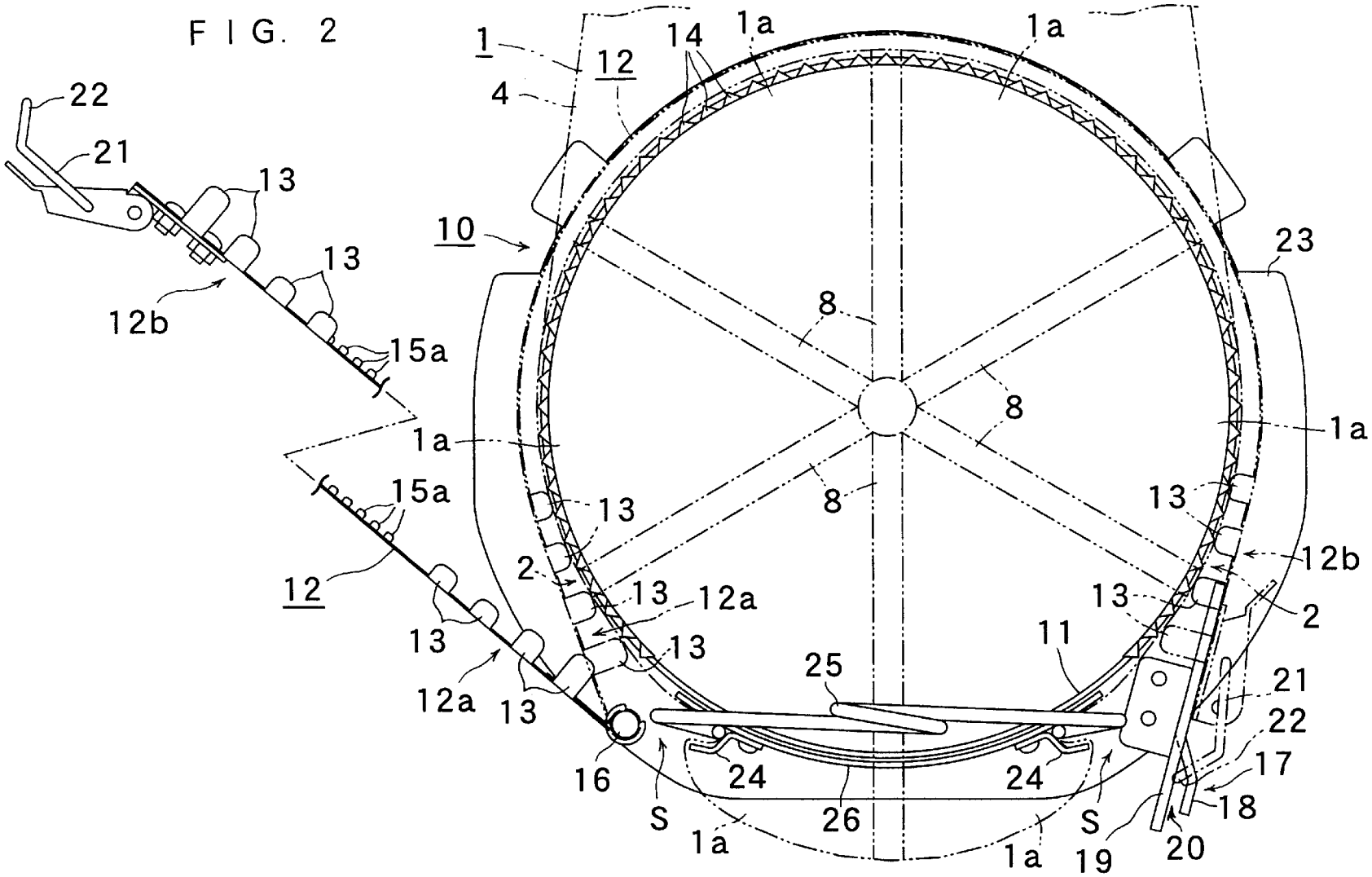
FIG. 2 is a front view of a headgear frame of the same headgear frame apparatus.
Figure 3:
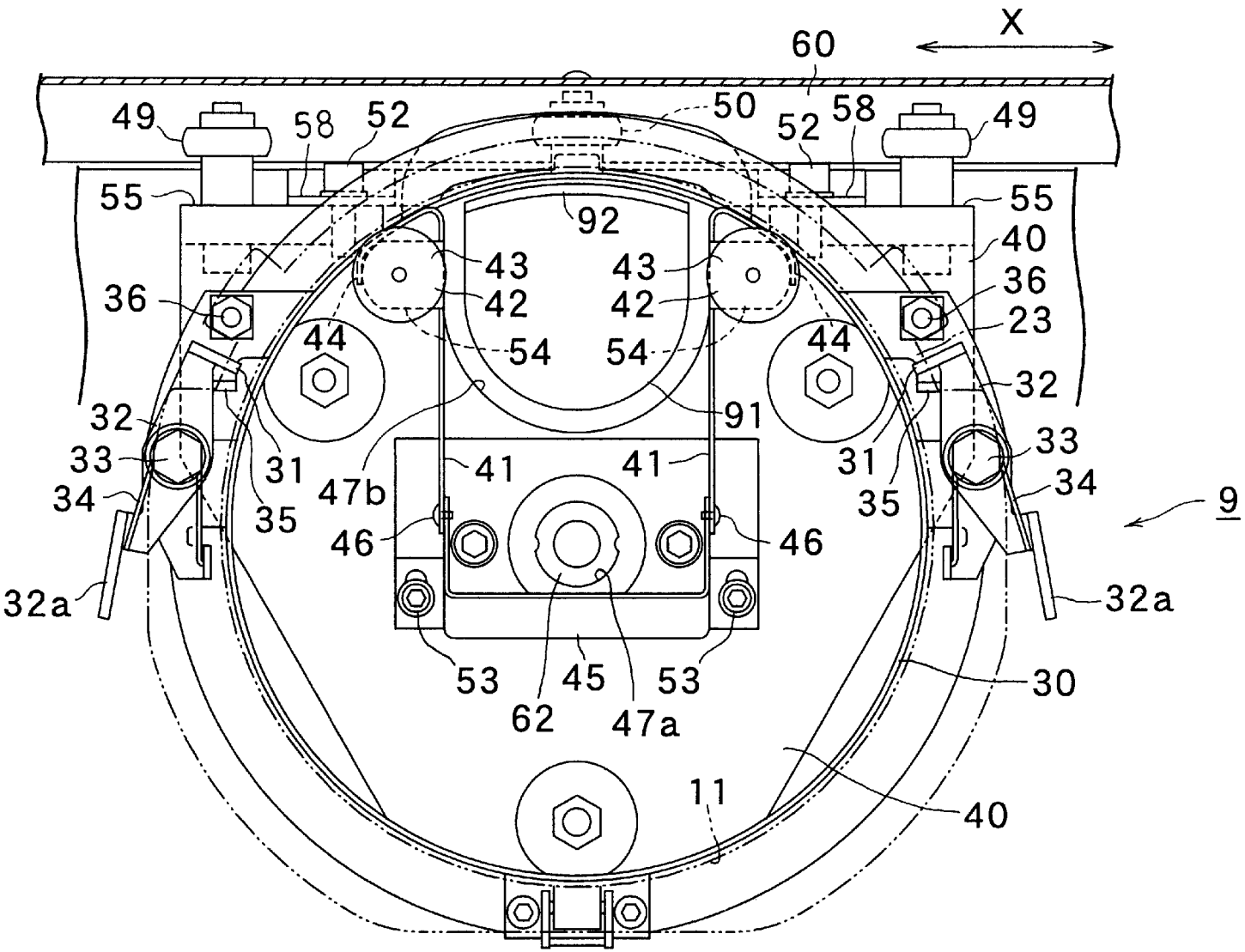
FIG. 3 is a front view of the same headgear frame apparatus.

FIGS. 1 to 4 show a headgear frame apparatus 9 for a sewing machine according to an embodiment of the invention. As shown in FIG. 1, this sewing machine is provided with a cylindrical bed 91 which is projected in parallel with a direction, as indicated by arrow Y, from a machine frame 90. Below and in parallel with the root end side of the cylindrical bed 91, there is projected a guide rail 62 which supports a headgear frame apparatus 9 including the headgear frame 10 in a manner to move in the direction Y. Over the cylindrical bed 91, there is further provided a horizontal drive frame 60 which extends in a horizontal plane in the direction X, as shown in FIG. 3, intersecting the direction Y at a right angle, so that the headgear frame apparatus 9 is moved by the horizontal drive frame 60.

On the upper face of the leading end side of the cylindrical bed 91, there is arranged a throat plate 92 which is provided with a needle eye 92*a* and below which there is packaged a (not-shown) hook wound with a bobbin thread. Over the cylindrical bed 91, on the other hand, there is provided a needle 93 which is made vertically movable in the (not-shown) machine head. And, a headgear (cap) 1, as held on the headgear frame apparatus 9, is embroidered by the association between the needle 93 to be driven on the basis of embroidering data and the aforementioned hook.

The headgear frame apparatus 9 is provided for supporting the embroidering range of the headgear 1 in a proper position just over the cylindrical bed 91. The headgear frame apparatus 9 is constructed to include: a support frame 40 made slidable in the direction Y along the guide rail 62; a rotary drive frame 30 so supported on the support frame 40 as to rotate on an axis parallel to the direction Y; the headgear frame 10 clamping the headgear 1 and replaceably engaged to outside of the rotary drive frame 30; elastic plates 41 mounted on a stay 45, as projected forward from the support frame 40, and extended sideways (to the left and right sides in the shown embodiment) of the cylindrical bed 91; and auxiliary rollers 42 provided rotatably at the leading ends of the elastic plates 41 and rotating in abutment against a boundary corner portion 7 between a circumferential portion 5 and a crest portion 6 of the headgear 1 clamped by the headgear frame 10.

This headgear frame 10 is provided, as shown in FIGS. 1 and 2, with a cylindrical receiving frame 11 to be inserted into the headgear 1, and a holding band 12 adapted to be wound on the outer side of the headgear 1 to clamp the headgear 1 between itself and the receiving frame 11.

The elastic plates 41 (i.e., two leaves in the shown embodiment) can warp in the directions close to and apart from the cylindrical bed 91. The elastic plates 41 are provided with mounting portions 54, which are formed by bending the leading end portions of the elastic plates 41 at a right angle with respect to the rotary shaft of the rotary drive frame 30, and contact pit faces 44, which are formed by bending the same leading end portions at the side of the throat plate 92 of the cylindrical bed 91 away from the cylindrical bed 91. On the mounting portions 54, as shown in FIGS. 1, 3 and 4, there are rotatably mounted auxiliary rollers 42 which are provided with semispherical faces 43 adapted to be fitted on the boundary corner portion 7.

Figure 4:
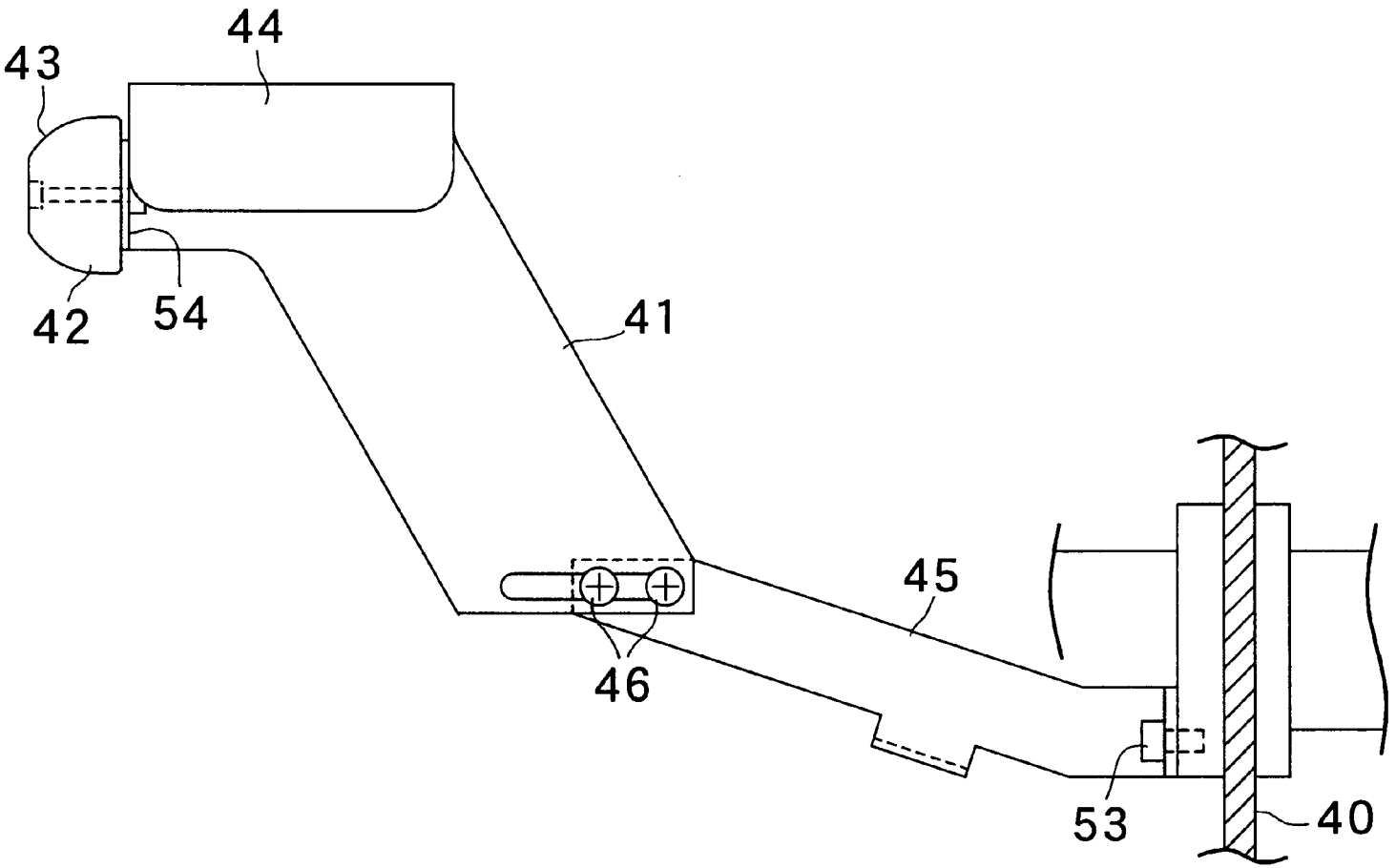
FIG. 4 is a righthand side view showing auxiliary rollers mounted on elastic plates of the same headgear frame apparatus.
Figure 5:
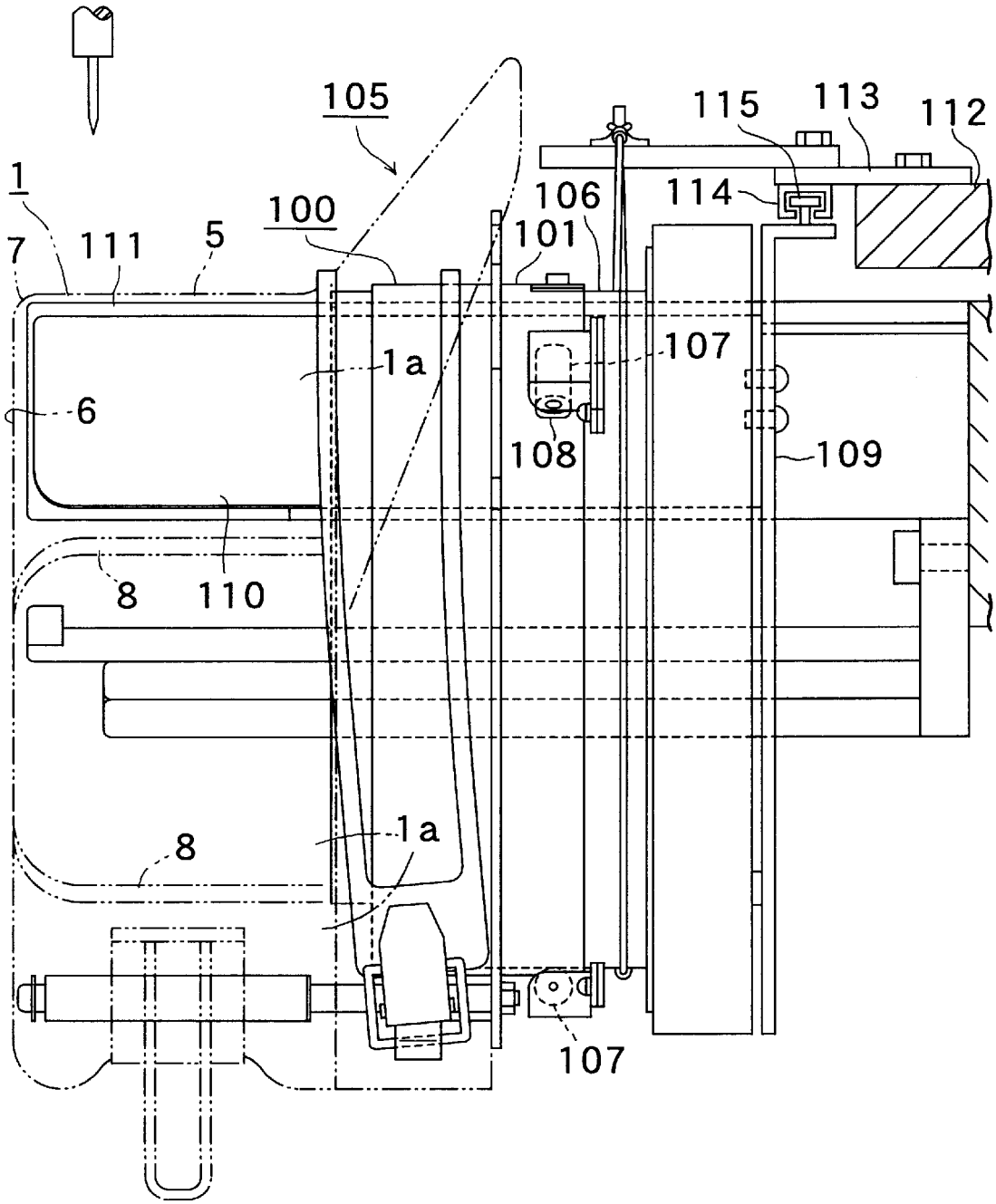
FIG. 5 PRIOR ART
FIG. 5 is a righthand side view showing a conventional headgear frame apparatus.

The contact pit faces 44 are so formed as to contact with the peripheral portion 5 of the headgear 1, as shown in FIGS. 1, 3 and 4, and are adjusted to be positioned generally on the extension of the arcuate surface of the throat plate 92 of the cylindrical bed 91, as shown in FIG. 3.

As shown in FIGS. 1, 3 and 4, the elastic plates 41 are positionally adjustably mounted on the stay 45 projected from the support frame 40 by screws 46. The stay 45 is positionally adjustably mounted on the support frame 40 by screws 53. By these positional adjustments, the auxiliary rollers 42 can be adjusted to abut snugly against the boundary corner portion 7, and the contact pit faces 44 can be adjusted to be positioned generally on the extensions of the arcuate surface of the throat plate 92.

When this headgear frame apparatus 9 is to be used, the cylindrical bed 91, the elastic plates 41 and the auxiliary rollers 42 are inserted into the inside of the receiving frame 11 of the headgear frame 10 clamping the headgear 1 to mount the headgear frame 10 on the rotary drive frame 30. Then, the contact pit faces 44 of the elastic plates 41 come into abutment of the peripheral portion 5 of the headgear 1 on the sides of the cylindrical bed 91. As a result, the peripheral portion of the headgear 1 over the cylindrical bed 91 are circumferentially tensed, and the semispherical faces 43 of the auxiliary rollers 42 come into abutment against the boundary corner portion 7 of the headgear 1, so that the headgear 1 is tensed longitudinally over the cylindrical bed 91.

When the horizontal drive frame 60 is moved in the direction X in accordance with embroidering data, moreover, the headgear 1 is turned together with the rotary drive frame 30 by a wire 61 which is connected to the horizontal drive frame 60. At this time, the auxiliary rollers 42 come, while rotating, into abutment against the boundary corner portion 7 of the headgear 1, and the elastic plates 41 warp at and according to the shape of ridges 8 of the headgear 1 so that the headgear 1 can turn smoothly without any drag. Moreover, the peripheral portion 5 of the headgear 1 to be moved over the cylindrical bed 91 is tensed circumferentially thereof by the contact pit faces 44 of the elastic plates 41 and longitudinally by the semispherical faces 43 of the auxiliary rollers 42.

The following effects can be achieved according to the headgear frame apparatus 9:

(a) Since the auxiliary rollers 42 abut against the boundary corner portion 7 of the headgear 1, the headgear 1 is tensed longitudinally to be hardly wrinkled, and the cloth being embroidered is little shrunk. As a result, the headgear 1 is decoratively embroidered; and (b) When the headgear 1 is to be embroidered in the turning direction, moreover, the auxiliary rollers 42 come, while rotating, into abutment against the boundary corner portion 7. Unlike the prior art, there will not arise the problem that the auxiliary rollers 42 are caught by the ridges 8 formed on the inner side of the headgear 1 (especially in the vicinities of the boundary corner portion 7) to damage the boundary corner portion 7. Because of little friction (or drag) at this time, moreover, the motion of the headgear 1 is smoothed in the turning direction in the vicinities of the pits (i.e., the contact pit faces 44). Unlike the prior art, therefore, there will not arise the problem that the side of the crest portion 6 of the headgear 1 cannot follow the turning motion of the rotary drive frame 30 to twist the peripheral portion 5 of the headgear 1.

Here, the present invention should not be limited to the aforementioned construction of the embodiment but could be embodied by making suitable modifications within the gist thereof such that the auxiliary rollers 42 are provided with conical faces to fit on the boundary corner portion 7.

As many apparently widely different embodiments of this invention may be made without departing from the spirit and scope thereof, it is to be understood that the invention is not limited to the specific embodiments thereof except as defined in the appended claims.

What is claimed is:

1. A headgear frame apparatus wherein auxiliary rollers for rotating in abutment against a boundary corner portion between a circumferential portion and a crest portion of a headgear clamped by a headgear frame are rotatably disposed sideways of a cylindrical bed of a sewing machine.

2. A headgear frame apparatus comprising: a headgear frame for clamping a headgear; a rotary drive frame for fitting said headgear frame replaceably thereon on the side of a sewing machine; and a support frame for supporting said rotary drive frame rotatably, wherein the improvement resides:

in that said support frame is provided with elastic plates extending to the side of a cylindrical bed of the sewing machine and capable of warping in the directions close to and apart from the cylindrical bed; and in that said elastic plates are provided rotatably with auxiliary rollers for rotating in abutment against a boundary corner portion between a circumferential portion and a crest portion of the headgear clamped by the headgear frame.

3. A headgear frame apparatus according to claim 2, wherein said auxiliary rollers are provided with semi-spherical faces or conical faces for fitting on said boundary corner portion.

4. A headgear frame apparatus according to claim 2, wherein said elastic plates are provided with contact pit faces for contacting with the circumferential portion of said headgear.

5. A headgear frame apparatus according to claim 3, wherein said elastic plates are provided with contact pit faces for contacting with the circumferential portion of said headgear.

6. A headgear frame apparatus according to claim 4, wherein said contact pit faces are adjusted to be positioned generally on the extension of the arcuate surface of a throat plate of said cylindrical bed.

7. A headgear frame apparatus according to claim 5, wherein said contact pit faces are adjusted to be positioned generally on the extension of the arcuate surface of a throat plate of said cylindrical bed.

8. A headgear frame apparatus according to claim 2, wherein said elastic plates are mounted at an adjustable position on a stay projected from said support frame by screws.

9. A headgear frame apparatus according to claim 3, wherein said elastic plates are mounted at an adjustable position on a stay projected from said support frame by screws.

10. A headgear frame apparatus according to claim 4, wherein said elastic plates are mounted at an adjustable position on a stay projected from said support frame by screws.

11. A headgear frame apparatus according to claim 5, wherein said elastic plates are mounted at an adjustable position on a stay projected from said support frame by screws.

12. A headgear frame apparatus according to claim 6, wherein said elastic plates are mounted at an adjustable position on a stay projected from said support frame by screws.

13. A headgear frame apparatus according to claim 7, wherein said elastic plates are mounted at an adjustable position on a stay projected from said support frame by screws.

* * * * *